United States Patent [19]

Beavers

[11] 4,004,326

[45] Jan. 25, 1977

[54] CABLE PROTECTOR

[75] Inventor: John Andrew Beavers, Tulsa, Okla.

[73] Assignee: Borg-Warner Corporation, Chicago, Ill.

[22] Filed: Dec. 22, 1975

[21] Appl. No.: 643,733

[52] U.S. Cl. ..... 24/81 CC; 166/241; 175/325

[51] Int. Cl.[2] ..... F16C 1/26; A44B 21/00; E21B 17/10

[58] Field of Search ..... 24/115 R, 81 CC, 81 BA, 24/263 DM; 175/325; 166/241, 175, 176; 248/49; 174/47

[56] References Cited

UNITED STATES PATENTS

| | | | |
|---|---|---|---|
| 478,092 | 7/1892 | Cushman | 24/81 BA UX |
| 2,163,932 | 6/1939 | Bettis | 166/241 |
| 2,829,190 | 4/1958 | Comlossy | 248/49 UX |
| 2,858,093 | 10/1958 | Knoll | 24/81 CC X |
| 3,218,385 | 11/1965 | Potruch | 24/81 CC X |
| 3,397,017 | 8/1968 | Grant et al. | 175/325 X |
| 3,612,627 | 10/1971 | Fuller | 175/325 X |
| 3,778,537 | 12/1973 | Miller | 24/81 CC X |
| 3,907,355 | 9/1975 | Carothers | 166/241 X |

FOREIGN PATENTS OR APPLICATIONS

| | | | |
|---|---|---|---|
| 560,916 | 4/1957 | Italy | 24/81 CC |

*Primary Examiner*—Donald A. Griffin
*Attorney, Agent, or Firm*—Aubrey L. Burgess

[57] ABSTRACT

A protector for protecting cable which is connected to a tubing string in a well. The protector is generally cylindrical having a bore adapted to be secured to the tubing of the string and is constructed in two pieces for ease of installation. A longitudinally extending slot is provided which is so dimensioned as to fully receive the cable. The protectors are spaced along the tubing string which may extend for great distances. The protectors may be of elastomeric material and may be eccentric with the cable receiving slot positioned in the thickest section. Lips overlying the slot may be provided as a measure to restrain the cable in the slot, to further protect cable from burrs or other protuberances and to provide wear points on the protector further from the cable.

4 Claims, 6 Drawing Figures

CABLE PROTECTOR

BACKGROUND OF THE INVENTION

Electrical cable which furnishes power to submersible motors is generally fastened to the well tubing or tubing string by means of bands or clamps. One elaborate form of such clamp is described in U.S. Pat. No. 3,757,387 issued to Bush et al. on Sept. 11, 1973. During installation, operation and withdrawal of the submersible pumping unit, the tubing string can move within the well casing sufficiently to permit crushing and/or tearing damage to the cable. This movement occurs in vertical holes and is especially damaging in deviated holes as cable may be on the high or low side of the hole. If cable is on the high side there may be insufficient clearance. If cable is on the low side sag in the tubing may crush it. Such damage causes premature pulling of the motors, expensive repairs, and thus loss of production.

THE INVENTION

The apparatus of this invention is a device which is generally cylindrical in form having a bore adapted to encompass the tubing string. It is made in two pieces for installation on the string; the two pieces are suitably connected, preferably by bolts, such feature provides for easy installation and removal and reinstallation. The devices are installed at spaced intervals along the length of the tubing string.

Along one side of each device, i.e., longitudinally thereof, is provided a slot which extends the full length of the protector and into which the cable is received. The slot configuration is such to receive either round or flat cable or any other cable section configuration. The cable is fully received in the slots and is held against the tubing by bands or clamps spaced from the opposite ends of each protector. Importantly, the cable can be inserted and removed from the protectors without dismantling or removing the protectors from the tubing.

The protectors may be so formed that the bore is eccentric with respect to the outer surface, with the slot in the thickest section of the device. Also, longitudinal lips may be provided along the edges of the slot to engage the cable, assist in positioning the cable in the slot, protect the cable from sharp burrs or other protuberance, move wear points on the protector further from the cable, and form a slot configuration which is receptive to both flat and round cable.

The protector may be made of any material which will withstand the environment and which will function to prevent the cable from contacting well casing walls and thereby being crushed or torn. For example it may be of a suitable elastomeric material; such may be reinforced with metal; it may be entirely metal or any suitable combination of metal, elastomeric or plastic materials.

THE DRAWINGS

DETAILED DESCRIPTION

Figure 1:
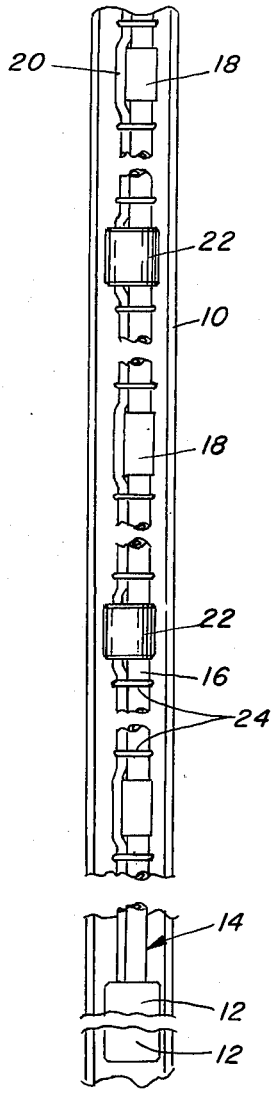
FIG. 1 is an elevational view illustrating a tubing string disposed in a well casing and showing the protectors of this invention in operative positions.

Looking at the drawings, and especially FIG. 1, there is a schematically illustrated portion of a well casing 10 into which has been lowered a submersible electric motor 12 (and a pump or the like to be driven by the motor) on the end of a tubing string, generally identified as 14. The tubing string is made up of sections of tubing 16 joined by collars 18 in the conventional manner. The electric cable 20 to the motor 12 is strung along the tubing string; at spaced intervals, the cable is protected by protectors 22 of this invention. The cable is fastened to the tubing string by clamps or bands 24, as indicated.

Figure 2:
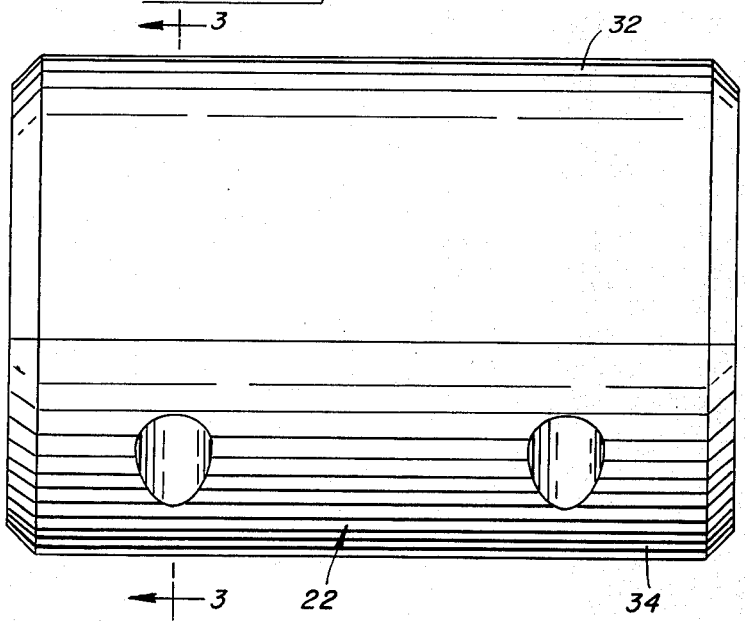
FIG. 2 is an elevational view of a cable protector of this invention.
Figure 3:
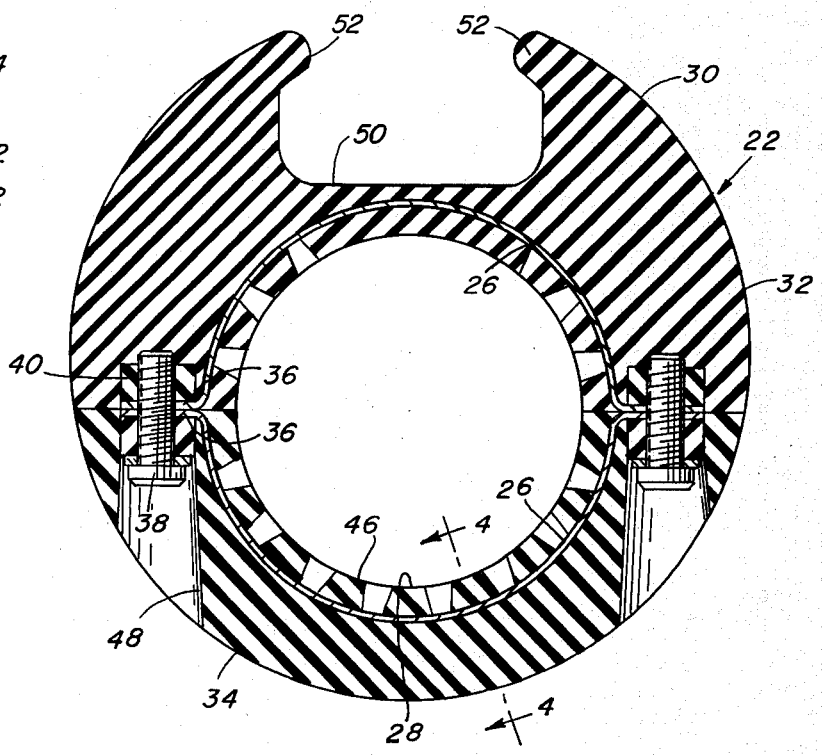
FIG. 3 is a sectional view, taken on line 3—3 of FIG. 2, illustrating the preferred embodiment of this invention.
Figure 4:
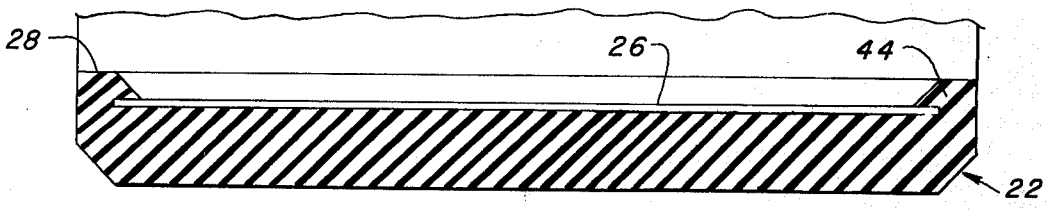
FIG. 4 is a sectional view taken on line 4—4 of FIG. 3.

A preferred embodiment of the cable protector 22 of this invention and this preferred embodiment is illustrated in FIGS. 2 to 4 of the drawings.

As illustrated the protector of FIGS. 2 to 4 is constructed of an elastomer, such as synthetic rubber which is reinforced by metal parts 26, 26. The protector is generally cylindrical in shape with an internal bore 28 disposed eccentric to the external surface 30 of the protector and is constructed to two parts 32, 34 separated on a plane passing through the axis of the bore 28. The part 32 has the greater thickness of material.

Each of the metal parts have radially extending flanges 36, adjacent ones of which abut one another when the parts are installed with the bore 28 receiving the tubing string 14. The parts 32, 34 are bolted together as illustrated; slot headed bolts 38 are received in threaded nuts 40 received in the elastomeric material of the protector. Suitable washers 42 are used as necessary.

The terminal ends 44 of the bore 28 are suitably formed to extend radially inwardly of the metal parts 26, 26 and may be notched, serrated or otherwise formed at 46 to deform and resiliently be connected to the tubing string. The part 34 is provided with openings 48 for access to the bolts 38, which bolts are thus recessed and do not protrude from the protector.

The thickest part of the part 32 is provided with a longitudinal slot 50 which is generally rectangular in section and into which the cable 20 is entirely received. There may be lips 52 overlying the edges of the slot 50 to positively retain the cable 20 therein to further protect the cable from sharp edges, move wear points on the protector further from cable, provide a slot the cross section of which will receive either flat or round cable and allow cable insertion or removal from slot without removing entire protector from the tubing. The protector 22 as just described may be produced by molding the parts in a conventional manner. And, of course, the protector may be made of different, yet suitable materials without departing from the spirit of the invention.

Figure 5:
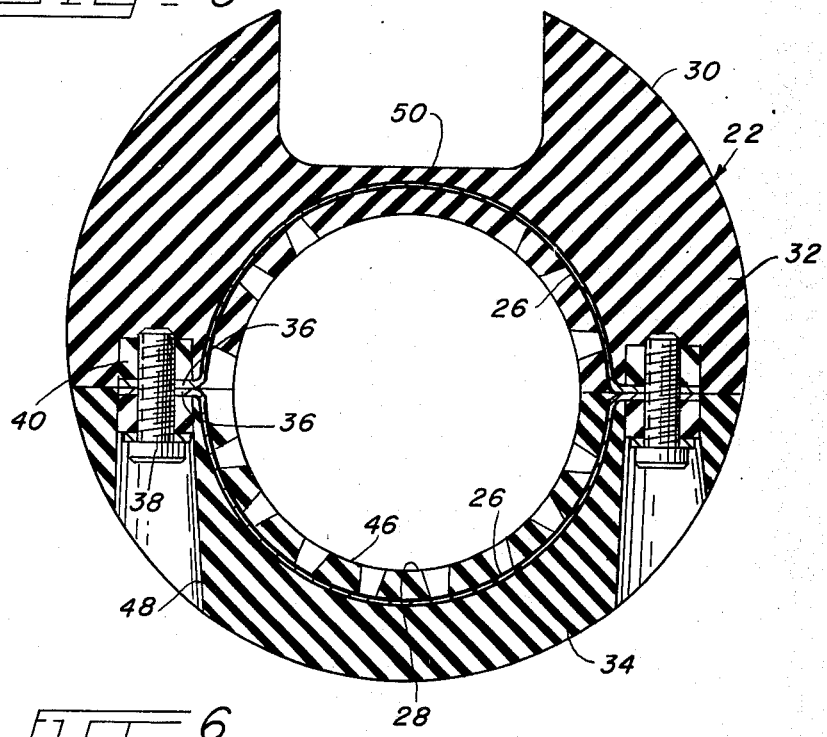
FIG. 5 is a sectional view, similar to FIG. 3, illustrating another embodiment of this invention.

FIG. 5 illustrates another embodiment of the invention which is similar to that described with reference to FIGS. 2 to 4 except the slot 50 is not flanked by lips; the other parts are the same so that the same description and reference numbers are applicable.

Figure 6:
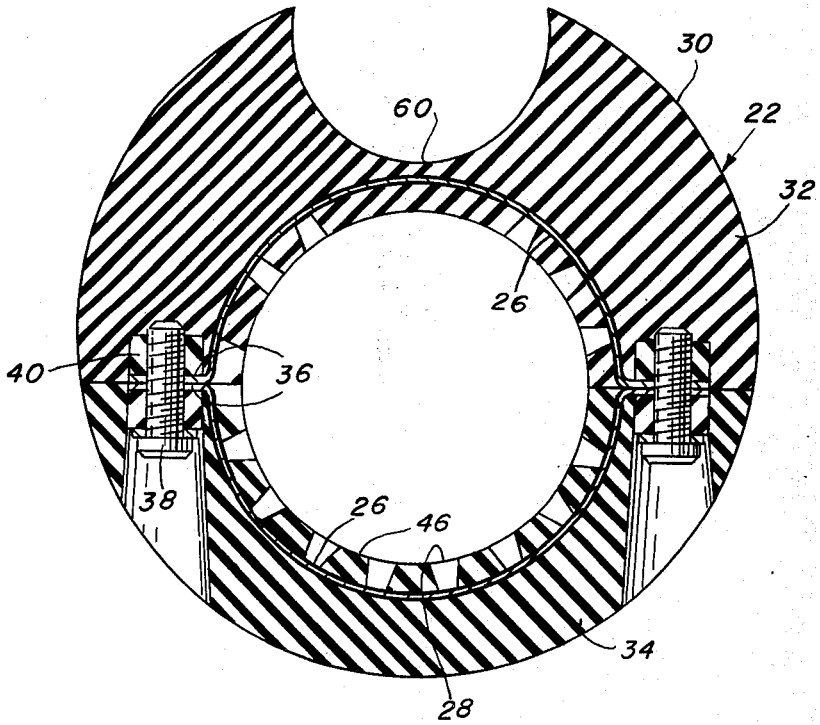
FIG. 6 is a sectional view, similar to FIG. 3 illustrating still another embodiment of this invention.

FIG. 6 illustrates yet another embodiment which again is similar to that described theretofore. The difference here is that the slot 60 is generally arcuate; otherwise the same description and reference characters apply.

I claim:

1. Apparatus for protecting cable connected to a tubing string comprising:

a generally cylindrical elastomeric material member having a cylindrical bore adapted to encompass and be secured to a portion of the length of the tubing of the string;

said bore being eccentric with respect to the periphery of said cylindrical member and providing thickest and thinest sections;

said cylindrical member being axially split into two portions for installation on the tubing string;

means for securing the two portions together; and means defining a longitudinal slot in the thickest section of said member for receiving cable which slot is dimensioned so that the cable is positioned entirely therewithin.

2. Apparatus as recited in claim 1 further comprising lips extending the length of said slot and overlying at least portions of said slot.

3. Apparatus as recited in claim 1 further comprising metal inserts in said elastomeric material, said metal inserts cooperating with said means for securing the two portions together.

4. Apparatus as recited in claim 3 in which a portion of elastomeric material closely adjacent said bore is notched so as to be distorted and tightly grip said tubing when said apparatus is applied to said tubing.

* * * * *